US006347966B1

(12) United States Patent
Hielscher

(10) Patent No.: US 6,347,966 B1
(45) Date of Patent: Feb. 19, 2002

(54) METHOD FOR MAKING BUS AND POST ELECTRICAL CONNECTOR USING DISPLACED BUS MATERIAL AND CONNECTOR PRODUCED THEREBY

(75) Inventor: Edward Hielscher, Ormond Beach, FL (US)

(73) Assignee: Homac Manufacturing Company, Ormond Beach, FL (US)

( * ) Notice: Subject to any disclaimer, the term of this patent is extended or adjusted under 35 U.S.C. 154(b) by 0 days.

(21) Appl. No.: 09/583,331

(22) Filed: May 31, 2000

(51) Int. Cl.[7] ..... H01R 11/09
(52) U.S. Cl. ..... 439/798; 439/756; 29/874
(58) Field of Search ..... 439/798, 797, 439/756, 212, 741, 723; 29/874, 884; 174/138 E, 138 G, 149 B

(56) References Cited

U.S. PATENT DOCUMENTS

| | | | | |
|---|---|---|---|---|
| 2,856,593 A | * | 10/1958 | Gookin | 439/731 |
| 4,521,067 A | * | 6/1985 | Dufresne | 439/522 |
| 4,715,832 A | * | 12/1987 | Bach | 439/723 |
| 5,555,620 A | | 9/1996 | Kies | 29/874 |
| 5,608,965 A | | 3/1997 | Kies | 29/874 |
| 5,611,142 A | | 3/1997 | Kies | 29/874 |
| 5,690,516 A | | 11/1997 | Fillinger | 439/798 |
| 5,766,044 A | | 6/1998 | Norden | 439/798 |
| 6,263,567 B1 | * | 7/2001 | McGrane | 29/884 |

OTHER PUBLICATIONS catalog—"Quality Electrical Connectors and Accessories", The Homac Companies–Industries Division, pp. 30–33.

* cited by examiner

*Primary Examiner*—Brian Sircus
*Assistant Examiner*—Michael C. Zarroli
(74) *Attorney, Agent, or Firm*—Allen, Dyer, Doppelt, Milbrath & Gilchrist, P.A.

(57) ABSTRACT

A method includes providing a bus having first and second opposing surfaces; providing a plurality of posts, each having a lower open end; positioning each post to have the lower open end adjacent the first surface of the bus; and displacing material from the bus into the lower open end of each post to secure each post to the bus. The displacing may include impacting at least the second surface of the metal bus. Also, in some embodiments, each post may have a bore extending therethrough and the method may further include positioning a forming tool in the bore during the displacing or impacting. In some embodiments, the displacing leaves the first and second surfaces of the bus continuous, that is, a small stub of bus material is displaced from the bus into the lower open end of the post and without punching through the bus. A recess is left in the second side of the bus. In other embodiments, the method may further include forming respective openings in the bus for the posts so that edge material adjacent the openings is displaced into the lower open ends of the posts.

24 Claims, 5 Drawing Sheets

METHOD FOR MAKING BUS AND POST ELECTRICAL CONNECTOR USING DISPLACED BUS MATERIAL AND CONNECTOR PRODUCED THEREBY

FIELD OF THE INVENTION

The present invention relates to the field of electrical connectors, and, more particularly, to an electrical connector and associated manufacturing method.

BACKGROUND OF THE INVENTION

Underground and submersible junction bus connectors are widely used in electrical power distribution systems. One type of such connector is offered under the designation SWEETHEART® by Homac Mfg. Company of Ormond Beach, Fla., the assignee of the present invention. The SWEETHEART® connector is a cast or welded aluminum connector including a bus, or bar, portion and a series of tubular posts extending outwardly from the bus portion. The posts have an open upper end to receive one or more electrical conductors. A threaded bore is provided in the sidewall of the post, and which receives a fastener to secure the electrical conductor within the upper end of the post. An insulating coating is provided on the lower portion of the posts and bus of the connector. In addition, EPDM insulating sleeves may be used to provide waterproof seals for the posts.

Unfortunately, the casting method for making such a connector may result in small trapped bubbles which leave internal voids in the casting. The internal voids may reduce the strength of the connector. The surface texture of the cast parts may be relatively rough, thereby requiring additional grinding or finishing steps. In addition, different molds are typically required for the different connector sizes and configurations. Accordingly, casting may be relatively expensive. In addition, a cast part may have a lower electrical conductivity.

U.S. Pat. Nos. 5,766,044; 5,555,620 and 5,608,965 each discloses an alternate approach to casting of the bus and post connector. A hollow-end milling cutter is used to form the entire extent of the upstanding posts from generally rectangular extruded stock material, and while also leaving the bus or bar portion at the base of the connector. In other words, an integrally formed monolithic connector is produced without casting and starting from extruded aluminum stock.

While the hollow-end milling approach offers a number of potential advantages, there are also shortcomings. In particular, a relatively large amount of the starting aluminum stock material must be removed and is therefore wasted. Also, the cost of the aluminum stock may also be relatively high because the stock must have a height dimension that is at least as great as the bus portion plus the full height of the posts. Of course, the number of required machining steps may increase the cost of the electrical connector produced by such hollow-milling cutter techniques.

SUMMARY OF THE INVENTION

In view of the foregoing background, it is therefore an object of the present invention to provide a method for making a bus and post connector without casting, and while reducing the waste and other drawbacks of the hollow-milling cutter approaches of the prior art.

These and other objects, features and advantages in accordance with the present invention are provided by a method comprising providing a bus and a plurality of posts, each post having a lower open end; positioning each post to have the lower open end adjacent a first surface of the bus; and displacing material from the bus into the lower open end of each post to secure each post to the bus. The bus and the posts preferably comprise an electrically conductive metal, such as aluminum. The method simplifies manufacturing of the connector, reduces waste compared to hollow-milling manufactured connectors, and may also overcome the disadvantages of a cast connector.

The displacing may comprise impacting at least the second surface of the bus. The displacing may also displace material from the bus radially outwardly to tightly engage adjacent portions of the post. Also, in some embodiments, each post may have a bore extending therethrough and the method may further include positioning a forming tool in the bore during the displacing or impacting.

In one class of embodiments of the invention, the displacing leaves the first and second surfaces of the bus continuous. In other words, a stub of bus material is displaced from the bus into the lower open end of the post and without punching through the bus. This forms a corresponding recess at the second or back surface of the bus.

In another class of embodiments, the method may further comprise forming respective openings in the bus for the posts. In these embodiments, the step of displacing comprises displacing edge material adjacent the openings into the lower open ends of the posts. The openings in the bus may permit the displaced material to extend further into lower open ends of the posts.

The bus may have a generally rectangular shape, such as in the shape of a bar. As mentioned briefly above, each post may be provided with a bore extending therethrough which defines the lower open end and also an open upper end for receiving at least one electrical conductor therein. Each post may also include at least one threaded passageway therein and extending transversely into the bore. The threaded passageway preferably receives a fastener to secure the electrical conductor in the post. Each post may also be provided with an increased thickness wall portion through which the threaded passageway extends to strengthen that portion of the post.

The connector may also include one or more different types of post. For example, the posts may comprise an uppermost tab with at least one opening therein for receiving a fastener to secure an electrical conductor thereto.

The method for making the connector may also include forming an insulating coating on at least the bus and lower portions of the posts. In addition, one or more posts may have different configurations, in terms or size and/or shape, than one or more other posts.

Another aspect of the invention relates to an electrical connector for connecting together a plurality of electrical conductors, as may be formed using the approaches described above. The connector preferably comprises a bus including a plurality of stubs extending outwardly from a first side and a corresponding plurality of recesses in the second side opposite the stubs, and a plurality of posts connected to the stubs. More particularly, each post has a lower open end engaged on a respective stub and an upper end to be connected to at least one electrical conductor. Since one method of making the connector uses displacement of material as described above, the volume defined by each recess may correspond to a volume of a corresponding stub.

In some embodiments, the first and second surfaces of the bus are continuous. In other embodiments, each stub has a bore extending therethrough, as these embodiments can be made by first forming openings aligned with the material that will be formed into the stubs.

DETAILED DESCRIPTION OF THE PREFERRED EMBODIMENTS

The present invention will now be described more fully hereinafter with reference to the accompanying drawings in which preferred embodiments of the invention are shown. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout. Prime notation is used in alternate embodiments to indicate similar elements.

Referring initially to FIGS. 1–7, an electrical connector 20 and method for making the connector are first described. The electrical connector 20 is of a type that includes a bus or bus portion 27 and a plurality of towers or posts 30*a*–30*d* extending outwardly therefrom, and wherein each post can receive one or more electrical conductors.

A method aspect of the invention is for making the electrical connector 20. The method preferably comprises providing a bus 27 having first and second opposing surfaces 27*a*, 27*b*, respectively. The method also includes providing a plurality of posts 30*a*–30*d*, each having a lower open end which will be secured to the bus 27. During assembly, each post 30*a*–30*d* preferably has its lower open end positioned adjacent the first surface 27*a* of the bus 27, and material is displaced from the bus into the lower open end of each post to secure each post to the bus.

Figure 5:
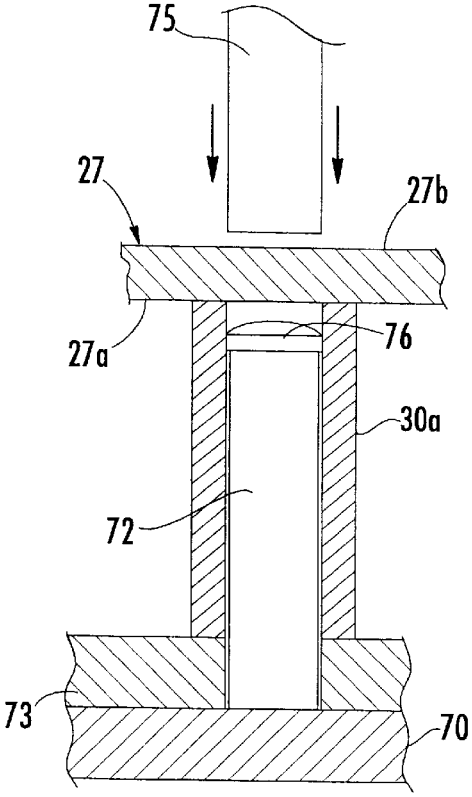
FIGS. 5 and 6 are schematic cross-sectional views of a portion of the bus and a post of the electrical connector being assembled together in accordance with the invention.
Figure 6:
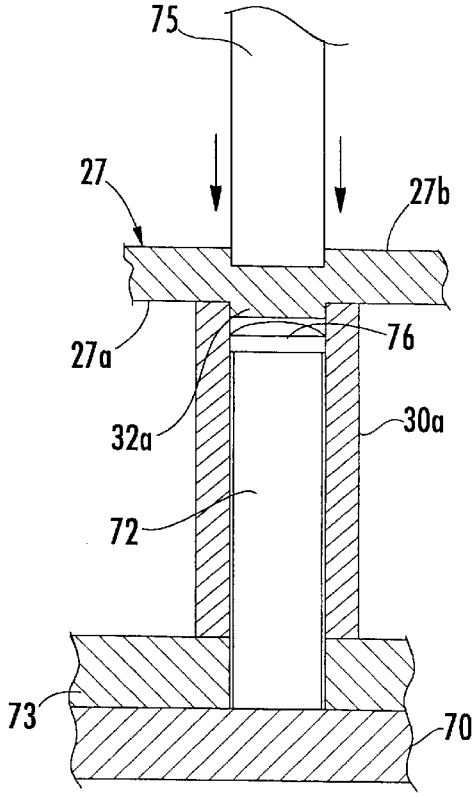
Figure 7:
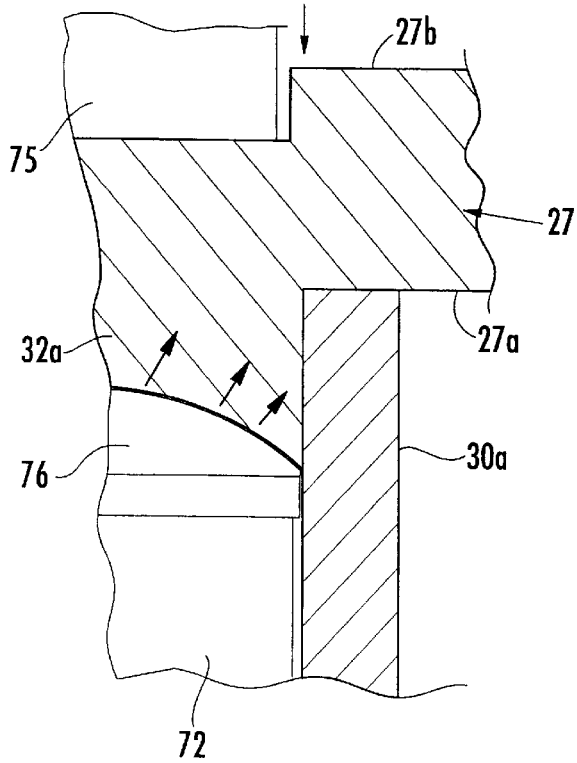
FIG. 7 is an enlarged schematic cross-sectional view of the upper righthand portion of FIG. 6 after further impacting.
Figure 8:
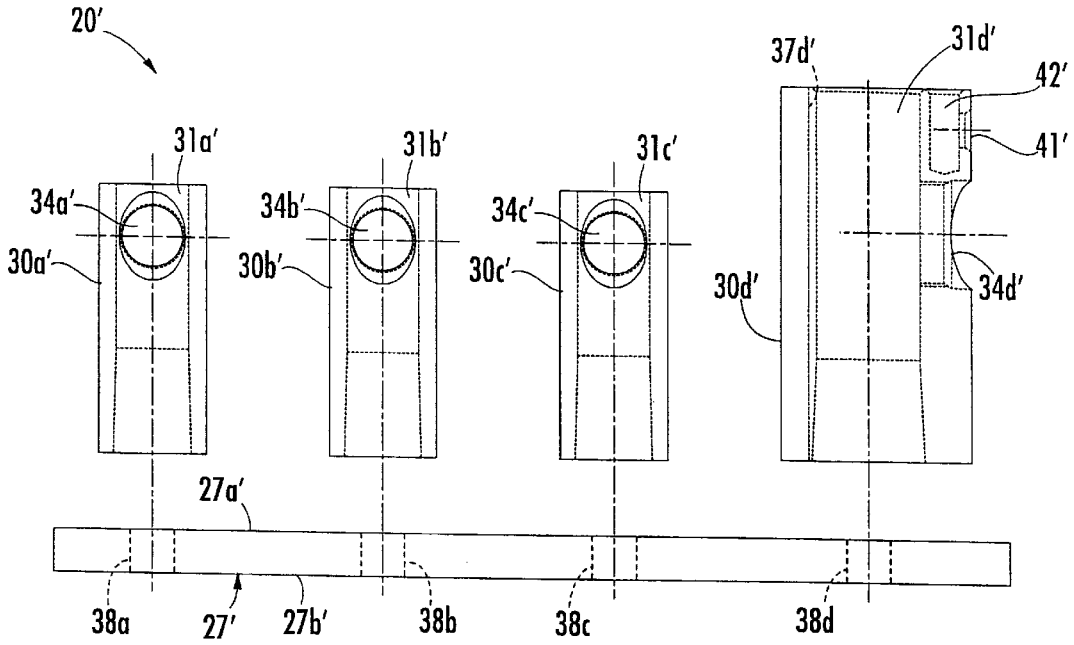
FIG. 8 is a side elevational view of the components of an alternate embodiment of an electrical connector prior to assembly of the bus and posts together in accordance with the invention.
Figure 9:
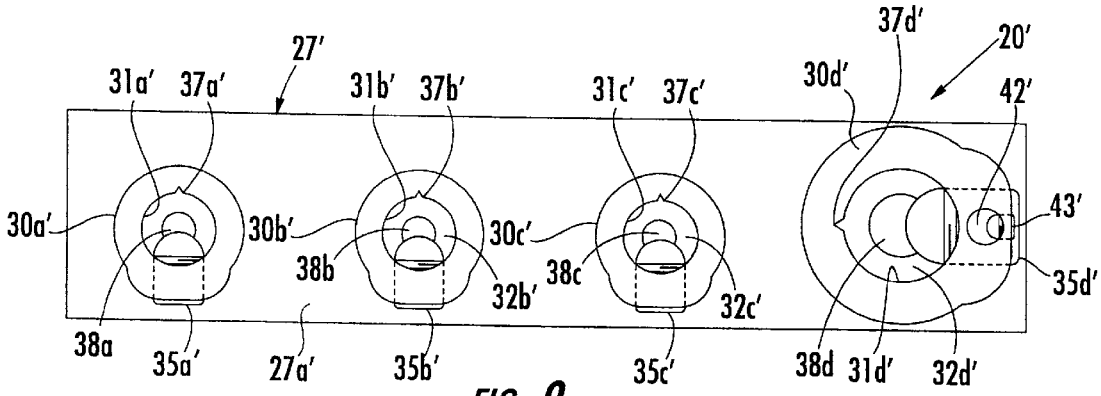
FIG. 9 is a top plan view of the alternate embodiment of the electrical connector after assembly of the bus and posts together in accordance with the invention.
Figure 10:
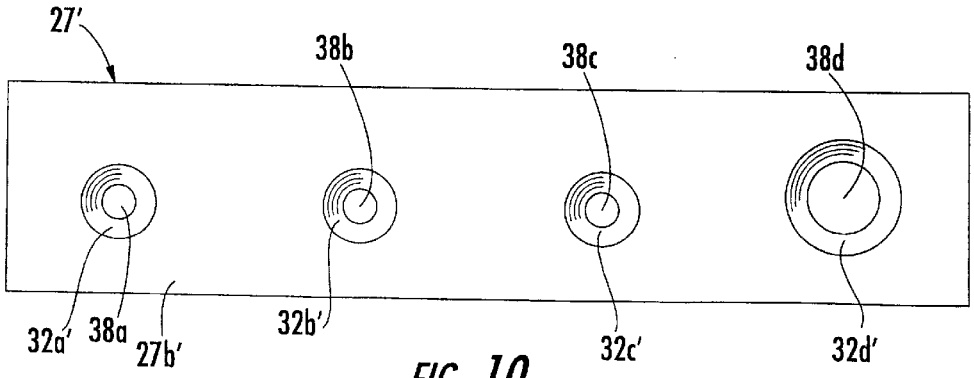
FIG. 10 is a bottom view of the connector as shown in FIG. 9.

The displacing may be accomplished as shown with particular reference to FIGS. 5–7. A punch holder plate 70 illustratively supports or mounts a first forming tool or pin 72. A stripper plate 73 is illustratively provided on the punch holder plate 70.

A second forming tool or pin 75 is illustratively moved downwardly into contact with the second or back side 27*b* of the bus 27. This motion causes impact of the end of the second forming pin 75 with the adjacent portions of the bus 27 and causes displacement of the material of the bus downwardly and outwardly from the first surface 27*a* into the shape of a stub 32*a* which extends outwardly from this first surface.

The displaced material or stub 32*a* securely attaches the post 30*a* to the bus 27. As shown in the illustrated embodiment, the first forming pin 72 may have an end 76 having a crown shape which serves to urge the displaced material radially outwardly to more tightly engage adjacent portions of the post 30*a* as perhaps best understood with reference to FIG. 7. The method simplifies manufacturing of the connector 20, reduces waste compared to hollow-milling manufactured connectors, and may also overcome the disadvantages of a cast connector.

In other embodiments, it may not be necessary to provide the first forming pin 72 to contact the displaced bus material. A pin or other jig could be readily provided to hold the post 30*a* in alignment during the impacting and displacing operation as will be appreciated by those skilled in the art. In addition, an alternate alignment and holding arrangement would be desired for post embodiments which do not include a central bore extending completely therethrough and defining the lower and upper open ends as shown in the illustrated posts 30*a*–30*d* for the connector 20. One such alternate post will described later herein.

The bus 27 and the posts 30*a*–30*d* preferably comprise metal, such as aluminum or extruded aluminum stock, for example. Such a material is electrically conducting and readily shapable to produce a locking stub 32*a* as will be appreciated by those skilled in the art. Of course, other metals and materials are also contemplated for the components of the connector 20 as will also be appreciated by those skilled in the art.

In the illustrated embodiment of FIGS. 1–7, the displacing leaves the first and second surfaces 27*a*, 27*b* of the bus 27 continuous. Stated in other terms, the stub 32*a* of bus material is displaced from the bus 27 into the lower open end of the post 30*a* and without punching or creating an opening completely through the bus. This does, however, form recesses 33*a*–33*d* at the second surface 27*b* of the bus 27 as seen perhaps best in bottom plan view of FIG. 4. Each recess 33*a*–33*d* defines a void or volume in the second side of the bus 27 substantially equal to the volume of material in the corresponding stub 32*a*–32*d* as will be appreciated by those skilled in the art. These recesses 33*a*–33*d* do not substantially effect the mechanical or electrical performance of the connector 20 as will also be appreciated by those skilled in the art.

The number, size and spacing of the stubs 32*a*–32*d* is dependent on the particular connector design desired. In the illustrated connector 20 four stubs are illustrated with the rightmost stub 32*d* having a larger diameter to accommodate a larger post 30*d* which, in turn, can accommodate a larger electrical conductor.

A slight taper angle may be provided in the lower open end of the posts 30*a*–30*d* in some embodiments to more readily and snugly secure the posts to the bus 27. For example, the taper angle may be in a range of about 1–5 degrees, although other angles are also contemplated by the invention. Straight surfaces may be also be readily accommodated in accordance with the present invention to thereby reduce the taper-forming machining step as will be appreciated by those skilled in the art.

Turning now additionally to FIGS. 8–12 another class of embodiments of the connector 20' in accordance with the invention are now described. The illustrated connector 20' includes a slightly modified bus 27' which has a plurality of openings 38*a*–38*d* formed therein prior to securing the posts to the bus and aligned with the posts 30*a*'–30*d*'. In these embodiments, the step of displacing material from the bus 27' comprises displacing edge material adjacent the openings 38*a*–38*d* into the lower open ends of the posts 30*a*'–30*d*'. The displaced material defines stubs 32*a*'–32*d*' each having a central bore or passageway extending therethrough.

The addition of the openings 38*a*–38*d* in the bus 27' may permit the displaced material that defines the stubs 32*a*'–32*d*' to extend further into lower open ends of the posts 30*a*'–30*d*' as will be readily appreciated by those skilled in the art. This, in turn, may provide a stronger mechanical connection between the bus 27' and the posts 30*a*'–30*d*' since the displaced material can be elongated in the vertical direction.

Figure 11:
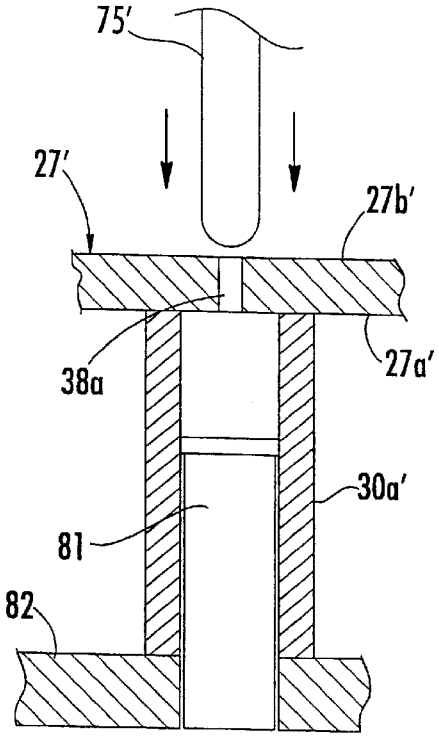
FIGS. 11 and 12 are schematic cross-sectional views of a portion of the bus and a post of the alternate embodiment of the electrical connector being assembled together in accordance with the invention.
Figure 12:
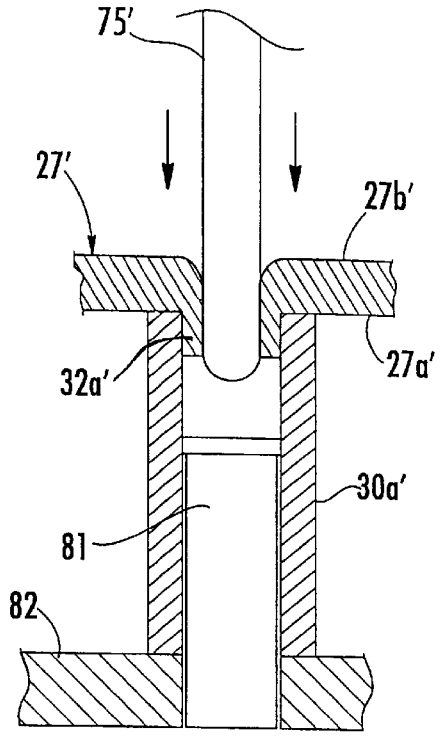

The first or lower forming pin 72 may be replaced in the illustrated embodiments of FIGS. 11 and 12 by a more simple guide pin 81. In addition, the guide pin 81 may be mounted on a holder plate 82 as shown in the illustrated embodiment and not need a stripper plate 73 as shown in FIGS. 5 and 6 as will be appreciated by those of skill in the art. This guide pin 81 need not contact the upper end of the displaced material or stub 32*a*'. Of course in other embodiments, some shaping of the end portions of the stub 32*a*' may be desired and this can be readily provided by using a suitable forming pin as will be appreciated by those of skill in the art.

The second or upper forming pin 75' may be slightly more narrow and include a rounded or slightly tapered end. This end may also be effectively used to urge the displaced bus material radially outwardly to provide a stronger contact with adjacent portions of the post 30*a*'.

Although it may be preferred to first form the bus openings 38*a*–38*d* before displacing material, in some variations, the method described with reference to FIGS. 1–7 can be used to form a similar connector 20' wherein the stubs 32*a*' have a central opening or passageway extending therethrough as will be appreciated by those skilled in the art. In other words, the upper or second forming pin 75 as shown in FIGS. 5–7 could be shaped and operated to not only displace material, but also to puncture the bus 27 and create an opening extending through the stub.

Those other elements of the embodiment of the connector 20' shown in FIGS. 8–12 are indicated with prime notation and are similar to elements described above with respect to the connector 20 shown in FIGS. 1–7. Accordingly, the additional elements indicated with prime notation require no further discussion herein.

Figure 1:
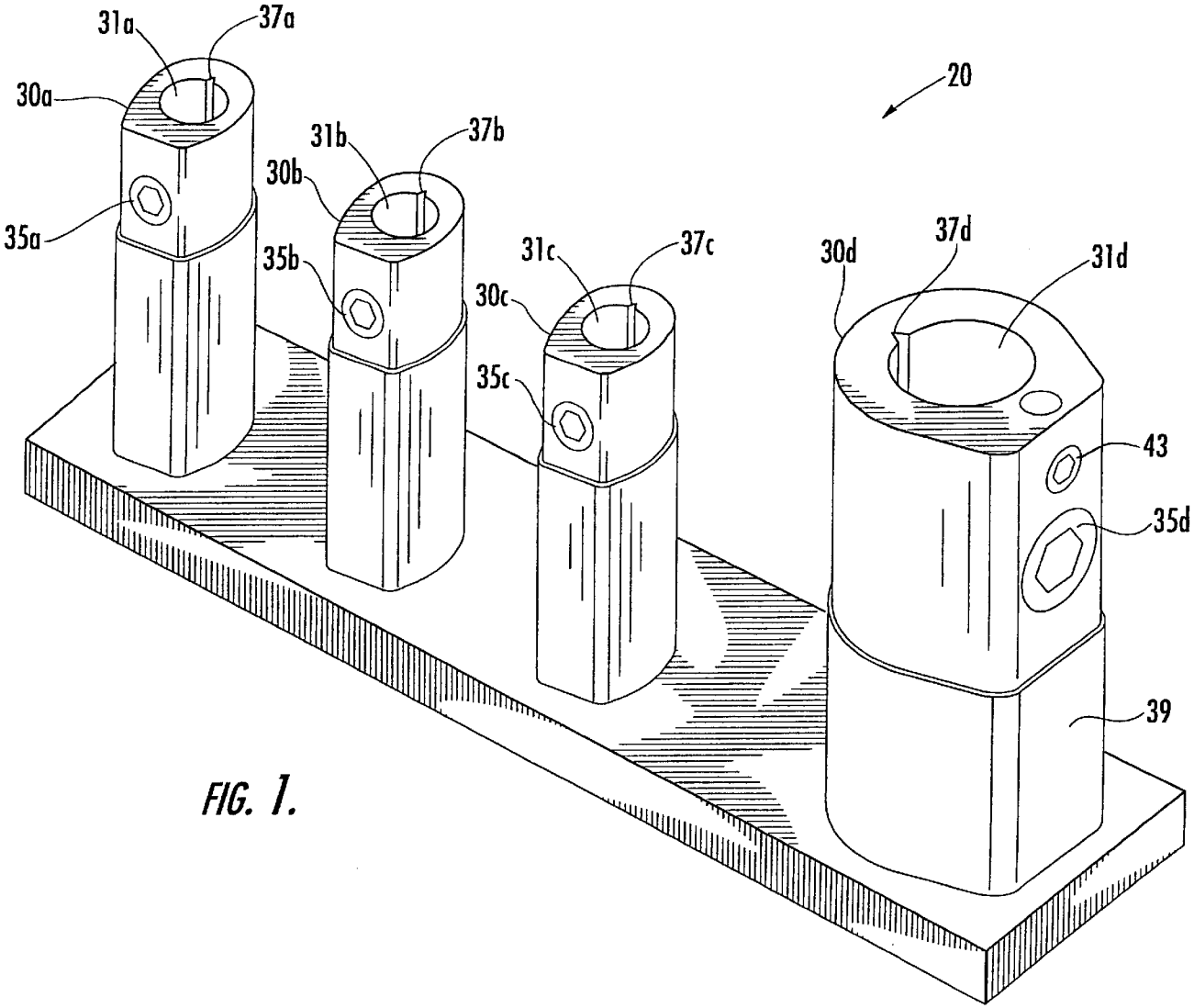
FIG. 1 is a perspective view of an electrical connector in accordance with the present invention.

Returning again to the connector 20 shown in FIG. 1, the bus 27 may have a generally rectangular shape, such as in the shape of a bar, as shown in the illustrated embodiment.

As mentioned above, each post 30*a*–30*d* may be provided with a bore 31*a*–31*d* extending therethrough which defines the lower open end and also an open upper end for receiving at least one electrical conductor therein. Each post 30*a*–30*d* may also include at least one threaded passageway 34*a*–34*d* (FIG. 2) therein and extending transversely into the bore. Each of the threaded passageways 34*a*–34*d* preferably receives a respective fastener 35*a*–35*d* (FIGS. 1 and 3) to secure the conductor in the post. For example, the fasteners may be a ball-ended screws each having a hexagonal recess therein as illustrated in FIG. 1.

Each post may also be provided with an increased thickness wall portion through which the threaded passageway 34*a*–34*d* extends to strengthen that portion of the post. The increased thickness wall portion permits a more efficient use of material, wherein strength and a larger wall thickness to receive a fastener are provided where needed in the illustrated embodiment. In other embodiments, the wall thickness may be uniform as will be appreciated by those skilled in the art.

Figure 2:
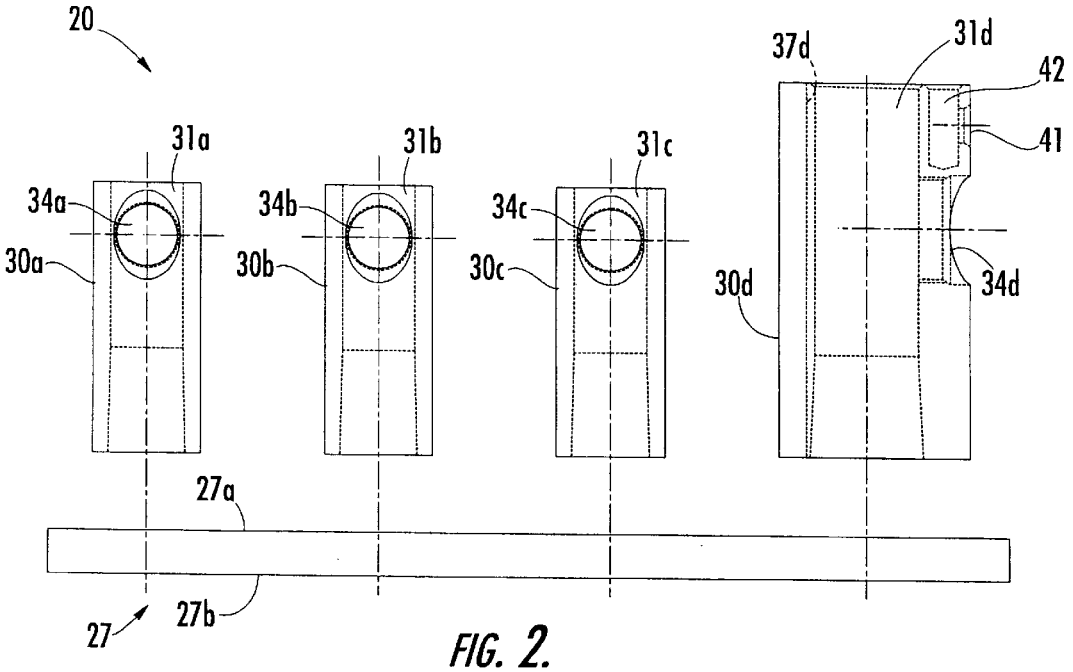
FIG. 2 is a side elevational view of the components of the electrical connector as shown in FIG. 1 prior to assembly of the bus and posts together.
Figure 3:
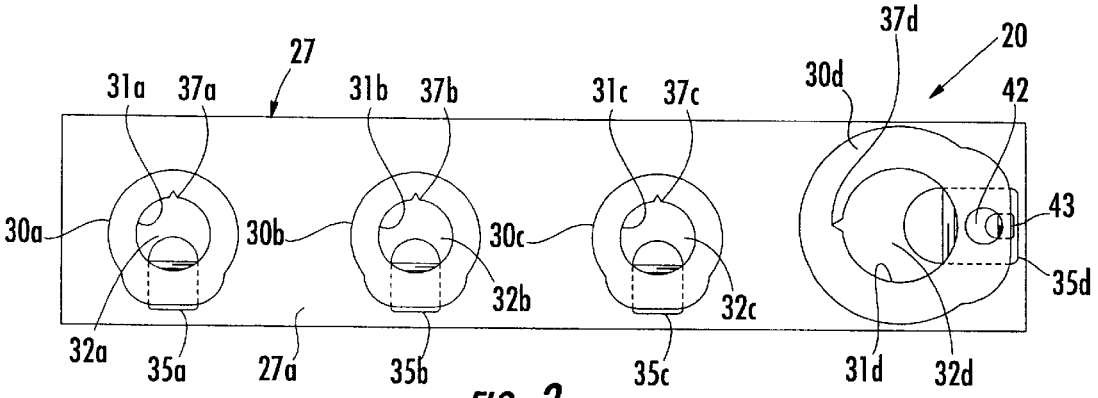
FIG. 3 is a top plan view of the electrical connector after assembly of the bus and posts together in accordance with the invention.
Figure 4:
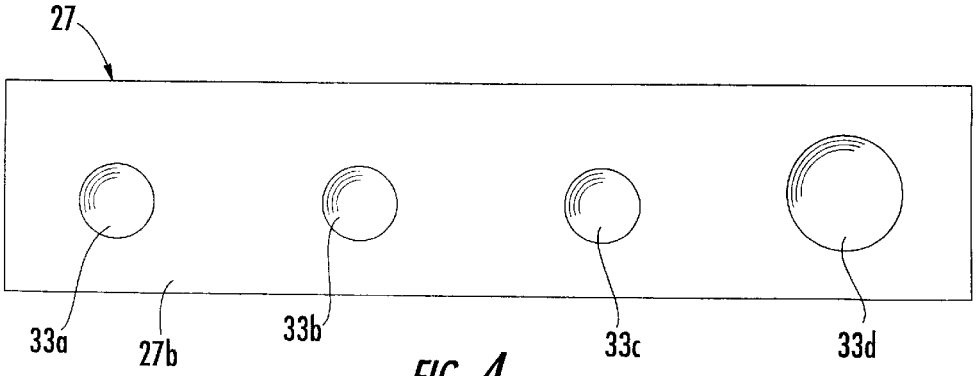
FIG. 4 is a bottom view of the connector as shown in FIG. 3.

As seen in FIGS. 1, 2 and 3, the largest post 30*d* in the illustrated connector 20 also includes a second bore 42, extending in the sidewall parallel to the main bore 31*d*, for receiving a smaller conductor. In addition, a second threaded passageway 41 (FIG. 2) is provided in communication with the second bore 42 to receive an associated screw or fastener 43 (FIGS. 1 and 3). Each of the posts 30*a*–30*d* also includes a vertical groove or recess 37*a*–37*d* which permits receiving a smaller gauge wire or conductor also in the main bore as will be appreciated by those skilled in the art. The illustrated metal posts 30*a*–30*d* include three identical posts 30*a*–30*c* and one larger post 30*d*. In other embodiments, all of the posts may be identical, for example, as will also be appreciated by those skilled in the art.

Figure 13:
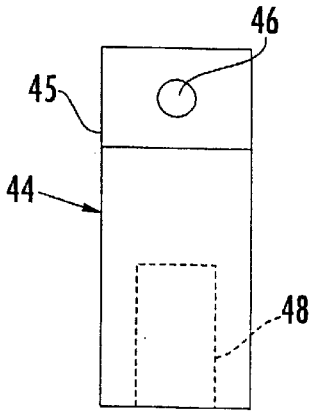
FIG. 13 is a front elevational view of an alternate embodiment of a post for use in the connector in accordance with the present invention.
Figure 14:
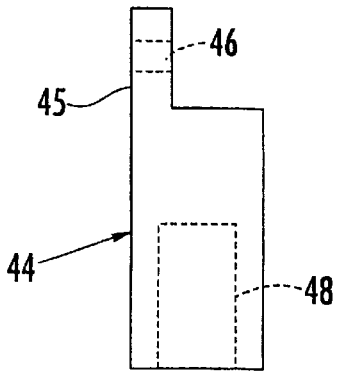
FIG. 14 is a side elevational view of the post as shown in FIG. 13.

The connector 20 may also include many different types of posts. The posts 30*a*–30*d* in the embodiment of the connector 20 as shown in FIGS. 1–7 are already described herein. As shown with additional reference to FIGS. 13 and 14, a different type of post 44 may also be used in accordance with another advantageous feature of the invention. The post 44 may comprise an uppermost tab 45 with at least one opening 46 therein for receiving a fastener to secure an electrical conductor thereto. Of course, the post 44 also includes a lower open end 48 for securing to the bus 27 as will be appreciated by those of skill in the art. This type of post 44 can be used exclusively or mixed and matched with the posts 30*a*–30*d* described above.

The method for making the connector 27 may also include forming an insulating coating 39 (FIG. 1) on at least the bus 27 and lower portions of the posts 30*a*–30*d*. The posts 30*a*–30*d* may have different configurations, in terms or size and/or shape, than other posts as shown in the illustrated embodiments.

A significant advantage of the present invention over the prior art is that the stock material waste is greatly reduced as compared to using hollow-milling cutting approaches. In addition, the invention may also offer the advantages of using extruded or other material versus cast material. Accordingly, many modifications and other embodiments of the invention will come to the mind of one skilled in the art having the benefit of the teachings presented in the foregoing descriptions and the associated drawings. Accordingly, it is understood that the invention is not to be limited to the illustrated embodiments disclosed, and that the modifications and embodiments are intended to be included within the spirit and scope of the appended claims.

That which is claimed is:

1. A method for making an electrical connector comprising a bus and a plurality of posts extending outwardly therefrom, the method comprising:

providing a bus having first and second opposing surfaces;

providing a plurality of posts, each having a lower open end;

positioning each post to have the lower open end adjacent the first surface of the bus; and displacing material from the bus into the lower open end of each post to secure each post to the bus.

2. A method according to claim 1 wherein displacing comprises impacting at least the second surface of the bus.

3. A method according to claim 1 wherein displacing further comprises displacing material radially outwardly to tightly engage adjacent portions of the post.

4. A method according to claim 1 wherein each post has a bore extending therethrough; and further comprising positioning a forming tool in the bore during the displacing.

5. A method according to claim 1 wherein displacing leaves the first and second surfaces of the bus continuous.

6. A method according to claim 1 wherein displacing forms a recess at the second surface of the bus for each post.

7. A method according to claim 1 further comprising forming an opening in the bus for each post; and wherein displacing comprises displacing edge material adjacent the opening into the lower open end of the post.

8. A method according to claim 1 wherein the bus has a generally rectangular shape.

9. A method according to claim 1 wherein at least one of the bus and posts comprises metal.

10. A method according to claim 1 wherein providing the posts comprises providing each post having a bore extending therethrough defining the lower open end and an open upper end for receiving at least one electrical conductor therein.

11. A method according to claim 10 wherein providing the posts comprises providing each post to have at least one threaded passageway therein and extending transversely into the bore.

12. A method according to claim 11 wherein providing the posts comprises providing each post having an increased thickness wall portion through which the at least one threaded passageway extends.

13. A method according to claim 1 wherein providing the posts comprises providing each post to comprise an uppermost tab with at least one opening therein for receiving a fastener to secure an electrical conductor thereto.

14. A method according to claim 1 further comprising forming an insulating coating on at least the bus and lower portions of the posts.

15. A method according to claim 1 wherein providing the posts comprises providing at least some of the posts with different configurations.

16. A method for making an electrical connector using a bus and a plurality of posts, the bus having first and second opposing surfaces, and each of the posts having a lower open end, the method comprising:

positioning each post to have the lower open end adjacent the first surface of the bus; and impacting at least the second surface of the bus to displace material from the bus into the lower open end of each post to thereby secure each post to the bus.

17. A method according to claim 16 wherein impacting also displaces material radially outwardly to tightly engage adjacent portions of the post.

18. A method according to claim 16 wherein each post has a bore extending therethrough; and further comprising positioning a forming tool in the bore during the impacting.

19. A method according to claim 16 wherein impacting leaves the first and second surfaces of the bus continuous.

20. A method according to claim 16 wherein impacting forms a recess at the second surface of the bus for each post.

21. A method according to claim 16 further comprising forming an opening in the bus for each post so that impacting displaces edge material adjacent the opening into the lower open end of the post.

22. A method according to claim 16 wherein the bus has a generally rectangular shape.

23. A method according to claim 16 wherein at least one of the bus and posts comprises metal.

24. A method according to claim 16 further comprising forming an insulating coating on at least the bus and lower portions of the metal posts.

* * * * *